United States Patent [19]

Law et al.

[11] Patent Number: 4,713,307

[45] Date of Patent: Dec. 15, 1987

[54] ORGANIC AZO PHOTOCONDUCTOR IMAGING MEMBERS

[75] Inventors: Kock-Yee Law, Fairport; James M. Wescott, Rochester, both of N.Y.

[73] Assignee: Xerox Corporation, Stamford, Conn.

[21] Appl. No.: 851,066

[22] Filed: Apr. 11, 1986

[51] Int. Cl.[4] ..... G03G 5/06; G03G 5/14

[52] U.S. Cl. ..... 430/57; 430/73

[58] Field of Search ..... 430/58, 57, 70, 75, 430/76, 78, 73

[56] References Cited

U.S. PATENT DOCUMENTS

| | | | |
|---|---|---|---|
| 4,299,896 | 12/1984 | Hashimoto et al. | 430/58 |
| 4,314,015 | 2/1982 | Hashimoto | 430/58 |
| 4,327,168 | 4/1982 | Hashimoto | 430/57 |
| 4,390,608 | 1/1983 | Hashimoto et al. | 430/57 |
| 4,390,611 | 6/1983 | Ishikawa et al. | 430/59 |
| 4,400,455 | 8/1983 | Hashimoto et al. | 430/59 |
| 4,480,019 | 10/1984 | Higashiguchi et al. | 430/76 |
| 4,486,519 | 12/1984 | Sasaki | 430/58 |
| 4,486,522 | 12/1984 | Hashimoto | 430/79 |
| 4,551,404 | 11/1985 | Hiro et al. | 430/59 |

FOREIGN PATENT DOCUMENTS

| | | |
|---|---|---|
| 60-64354 | 4/1985 | Japan . |
| 60-111247 | 6/1985 | Japan . |

*Primary Examiner*—John L. Goodrow

*Attorney, Agent, or Firm*—E. O. Palazzo

[57] ABSTRACT

A photoconductive imaging member containing a supporting substrate, certain azo pigments of 2,7-bis(1'-azo-2'-hydroxy-3'-naphthanilide)naphthalene and the derivatives thereof, and a hole transport layer. The aforementioned disposable imaging members are particularly useful in electrostatographic imaging and printing apparatuses in that they enable high quality images of excellent resolution, and wherein the electrical properties of the resulting imaging members are substantially stable over extended time periods.

44 Claims, 28 Drawing Figures

| Compound # | % Yield | C % | | H % | | N % | | M. P. °C | IR(C=O)cm$^{-1}$ | $V_{ddp}$ (V) | Dark Decay (V/sec) | $E_{0.5ddp}$ (Ergs/cm$^2$) at 600 nm |
|---|---|---|---|---|---|---|---|---|---|---|---|---|
| | | Found | (Calc'd) | Found | (Calc'd) | Found | (Calc'd) | | | | | |
| 1-1 | 67 | 73.70 | 74.78 | 4.35 | 4.28 | 11.84 | 11.89 | >300 | 1675 | -960 | -75 | 5.0 |
| 1-2 | 65 | 74.87 | 75.19 | 4.74 | 4.66 | 11.57 | 11.44 | >300 | 1678 | -990 | -30 | 21.5 |
| 1-3 | 16 | - | - | 3.57 | 4.66 | 10.72 | 11.44 | >300 | 1670 | -550 | -40 | 17.4 |
| 1-4 | 55 | 75.12 | 75.19 | 4.84 | 4.66 | 11.20 | 11.44 | >300 | 1668 | -980 | -75 | 12 |
| 1-5 | 67 | 74.70 | 75.57 | 5.22 | 5.02 | 10.92 | 11.02 | >300 | 1678 | -900 | -55 | 35.2 |
| 1-6 | 45 | 71.34 | 72.05 | 4.65 | 4.47 | 10.89 | 10.96 | >300 | 1668 | -970 | -25 | 50.3 |
| 1-7 | 34 | 70.80 | 72.05 | 4.52 | 4.47 | 10.59 | 10.96 | >300 | 1674 | -900 | -60 | 40 |
| 1-8 | 50 | - * | - | 4.49 | 4.47 | 10.69 | 10.96 | >300 | 1662 | -1000 | -40 | 450 |
| 1-9 | 68 | 68.05 | 68.13 | 3.99 | 3.64 | 10.83 | 10.84 | >300 | 1675 | -980 | -50 | 27 |
| 1-10 | 58 | 67.86 | 68.13 | 3.89 | 3.64 | 10.83 | 10.84 | >300 | 1676 | -920 | -115 | 7.9 |
| 1-11 | 57 | 67.83 | 68.13 | 3.90 | 3.64 | 10.68 | 10.84 | >300 | 1678 | -940 | -30 | 93 |

*UNDETERMINED

FIG. 1A

| Compound # | % Yield | C % | | H % | | N % | | M. P. °C | IR(C = O)cm$^{-1}$ | $V_{ddp}$ (V) | Dark Decay (V/sec) | $E_{0.5ddp}$ (Ergs/cm$^2$) at 600 nm |
|---|---|---|---|---|---|---|---|---|---|---|---|---|
| | | Found | (Calc'd) | Found | (Calc'd) | Found | (Calc'd) | | | | | |
| 1-12 | 51 | 68.83 | 68.74 | 4.36 | 4.01 | 10.68 | 10.45 | >300 | 1660 | - | - | - |
| 1-13 | 73 | 70.14 | 71.15 | 4.07 | 3.80 | 12.06 | 11.31 | >300 | 1678 | -940 | -30 | 161 |
| 1-14 | 69 | 70.25 | 71.15 | 4.11 | 3.80 | 10.99 | 11.31 | >300 | 1676 | -970 | -45 | 44 |
| 1-15 | 61 | 70.53 | 71.15 | 4.07 | 3.80 | 11.09 | 11.31 | >300 | 1667 | -960 | -50 | 53 |
| 1-16 | 24 | 66.10 | 66.33 | 3.66 | 3.54 | 13.55 | 14.66 | >300 | 1680 | -860 | -70 | 13.9 |
| 1-17 | 78 | - * | - | 3.20 | 3.54 | 12.92 | 14.06 | >300 | 1673 | - | - | - |
| 1-18 | 39 | 66.91 | 66.33 | 3.86 | 3.54 | 13.59 | 14.06 | >300 | 1686 | -860 | -115 | 10.9 |
| 1-19 | 54 | 74.58 | 75.57 | 5.04 | 5.02 | 10.84 | 11.02 | >300 | 1676 | -930 | -70 | 11 |
| 1-20 | 54 | 77.11 | 77.41 | 4.45 | 4.25 | 11.14 | 10.42 | >300 | 1671 | -780 | -160 | 27.2 |
| 1-21 | 53 | 76.91 | 77.41 | 4.56 | 4.25 | 10.82 | 10.42 | >300 | 1670 | -995 | -20 | 18.8 |
| 1-22 | 50 | 74.07 | 73.72 | 3.86 | 4.27 | 10.23 | 11.86 | >300 | 1665 | -580 | -60 | 283 |

* *UNDETERMINED*

FIG. 1B

ORGANIC AZO PHOTOCONDUCTOR IMAGING MEMBERS

BACKGROUND OF THE INVENTION

This invention is directed to novel azo compounds and their use as photogenerating pigments in photoconductive imaging members. More specifically, the present invention is directed to novel 2,7-bis azo pigments and layered photoconductive imaging members comprised of these pigments, and a hole transport layer. In one specific embodiment of the present invention, the layered photoresponsive imaging members are comprised of novel 2,7-bis(1'-azo-2'-hydroxy-3'-naphthanilide)napnthalene and the derivatives thereof, and in contact therewith an aryl amine hole transport layer. The aforementioned imaging members are particularly useful in electrostatographic imaging processes and in printing processes and apparatuses, wherein there is enabled high quality images of excellent resolution, which members because of their low cost are classified as disposable.

Numerous different xerographic photoconductive members are known including, for example, a homogeneous layer of a single material such as vitreous selenium, or a composite layered device containing a dispersion of a photoconductive composition. An example of one type of composite xerographic photoconductive member is described, for example, in U.S. Pat. No. 3,121,006 wherein there is disclosed finely divided particles of a photoconductive inorganic compound dispersed in an electrically insulating organic resin binder. These members contain, for example coated on a paper backing, a binder layer containing particles of zinc oxide uniformly dispersed therein. The binder materials disclosed in this patent comprise a material such as polycarbonate resins, polyester resins, polyamide resins, and the like, which are incapable of transporting for any significant distance injected charge carriers generated by the photoconductive particles. Accordingly, as a result the photoconductive particles must be in a substantially contiguous particle to particle contact throughout the layer for the purpose of permitting charge dissipation required for a cyclic operation.

There are also known photoreceptor materials comprised of inorganic or organic materials wherein the charge carrier generating, and charge carrier transport functions are accomplished by discrete contiguous layers. Additionally, layered photoreceptor materials are disclosed in the prior art which include an overcoating layer of an electrically insulating polymeric material. However, the art of xerography continues to advance and more stringent demands need to be met by the copying apparatus in order to increase performance standards, and to obtain higher quality images.

Recently, there have been disclosed other layered photoresponsive devices including those comprised of separate generating layers, and transport layers as described in U.S. Pat. No. 4,265,990; and overcoated photoresponsive materials containing a hole injecting layer, overcoated with a hole transport layer, followed by an overcoating of a photogenerating layer, and a top coating of an insulating organic resin, reference U.S. Pat. No. 4,251,612. Examples of photogenerating layers disclosed in these patents include trigonal selenium and phthalocyanines, while examples of transport layers include certain diamines as mentioned herein. The disclosures of each of these patents, namely U.S. Pat. Nos. 4,265,990 and 4,251,612, are totally incorporated herein by reference.

Many other patents are in existence describing photoresponsive devices including layered devices containing generating substances, such as U.S. Pat. No. 3,041,167 which discloses an overcoated imaging member containing a conductive substrate, a photoconductive layer, and an overcoating layer of an electrically insulating polymeric material. This member is utilized in an electrophotographic copying system by, for example, initially charging the member with an electrostatic charge of a first polarity, and imagewise exposing to form an electrostatic latent image which can be subsequently developed to form a visible image.

Furthermore, there are disclosed in U.S. Pat. Nos. 4,232,102 and 4,233,383 photoresponsive imaging members comprised of trigonal selenium doped with sodium carbonate, sodium selenite, and trigonal selenium doped with barium carbonate, and barium selenite or mixtures thereof. Moreover, there are disclosed in U.S. Pat. No. 3,824,099 certain photosensitive hydroxy squaraine compositions. According to the disclosure of this patent, the squaraine compositions are photosensitive in normal electrostatographic imaging systems.

Also known are photoconductive devices containing therein various squaraine compositions. Thus, for example, there are illustrated in U.S. Pat. No. 4,508,803, the disclosure of which is totally incorporated herein by reference, photoconductive devices containing novel benzyl fluorinated squaraine compositions. Specifically, in one embodiment illustrated in the '803 patent there is described an improved photoresponsive device comprised of a supporting substrate, a hole blocking layer, an optional adhesive interface layer, an inorganic photogenerating layer, a photoconducting composition layer comprised of benzyl fluorinated squaraine compositions, and a hole transport layer. Other representative patents disclosing photoconductive devices with squaraine components therein, or processes for the preparation of squaraines include U.S. Pat. Nos. 4,507,408; 4,552,822; 4,559,286; 4,507,480; 4,524,220; 4,524,219; 4,524,218; 4,525,592; 4,559,286; 4,415,639; 4,417,041; and 4,486,520. The disclosures of each of the aforementioned patents are totally incorporated herein by reference.

Also, disclosed in the published literature are composite electrophotographic photosensitive materials with various azo compounds. For example, there are illustrated in Japanese Ricoh Patent Publication No. 6064354, published Apr. 12, 1985, composite photoconductors wherein one of the photoconductor layers contain an azo compound of the formulas as illustrated. Some of the azo photoconductive compounds, of the present invention are related to the aforementioned compounds reference particularly when Z is p—$C_6H_4$—p—$C_6H_4$—p—$C_6H_4$, of 1,5-naphthalene. Further, there are illustrated in several U.S. Patents layered organic electrophotographic photoconductor elements with azo, bisazo, or related compounds. Examples of these patents include U.S. Pat. Nos. 4,400,455; 4,551,404; 4,390,608; 4,327,168; 4,299,896; 4,314,015; 4,486,522; 4,486,519; 4,551,404; and Konishiroku Japanese Patent Laid Open Publication No. 60111247.

Although photoconductive imaging members with azo compounds are known, including those that are similar to the azo compounds of the present invention, there remains a need for disposable photoconductor devices. Additionally, there continues to be a need for layered photoresponsive imaging members having incorporated therein certain azo compounds, which members will enable the generation of acceptable high quality images, and wherein these members can be repeatedly used in a number of imaging cycles without deterioration thereof from the machine environment or surrounding conditions. Moreover, there is a need for improved layered photoresponsive imaging members wherein the azo compounds selected for one of the layers are substantially inert to the users of such members. Additionally, there is an important need for layered photoconductors with azo compounds, which photoconductors are of low cost, high sensitivity, and possess high cyclic stability. There also is a need for azo photoconductors that possess high panchromaticity.

SUMMARY OF THE INVENTION

It is therefore an object of the present invention to provide photoresponsive imaging members containing therein certain azo compounds.

A further object of the present invention is the provision of improved photoconductive imaging members with high sensitivity and excellent stability.

Additionally, in a further object of the present invention there are provided disposable photoconductive imaging members.

Another object of the present invention resides in the provision of disposable organic layered photoconductive imaging members containing therein certain azo compounds as photogenerating layers and aryl amine hole transport layers.

In yet another specific object of the present invention there are provided improved layered photoresponsive devices containing the azo compounds illustrated herein functioning as photogenerating layers, situated between a supporting substrate and an aryl amine hole transport layer.

Further, in yet another object of the present invention there are provided imaging and printing methods with the improved photoresponsive imaging members illustrated herein.

Also, in a further important object of the present invention there are provided disposable azo photoresponsive imaging members that are highly panchromatic.

These and other objects of the present invention are accomplished by the provision of layered photoconductive imaging members containing therein certain azo compounds. More specifically, the layered photoconductive imaging members of the present invention are comprised of specific azo compounds, which function as a photogenerating source, and in contact therewith a hole transport layer preferable comprised of aryl diamines.

Accordingly, the photoconductive layered imaging members of the present invention are comprised of, for example, a supporting substrate, an aryl diamine hole transport layer, and an azo compound, reference FIG. 1, of the formula:

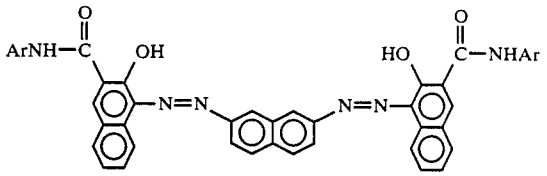

wherein Ar represents an aromatic or substituted aromatic substituent.

Examples of the aforementioned aromatic substituents include those containing from about 6 to about 24 carbon atoms such as phenyl, anthryl, and naphthyl. These aromatic substituents can contain thereon various substituted groups including alkyl, halogen, nitro, alkoxy, and the like. Alkyl groups include those of from about 1 to about 20 carbon atoms such as methyl, ethyl, propyl, butyl, pentyl, hexyl, and decyl; while examples of alkoxy groups are those of from about 1 to about 10 carbon atoms such as methoxy, ethoxy, propoxy, butoxy, and hexoxy. Halogens include chloride,, fluoride, bromide, and iodide.

Illustrative examples of specific azo compounds selected for the photoconductive imaging members of the present invention inclue 2,7-bis(1'-azo-2'-hydroxy-3'-naphthanilide)naphthalene; 2,7-bis(1'-azo-2'-hydroxy-3'-naphtho-p-toluidide)naphthalene; 2,7-bis(1'-azo-2'-hydroxy-3'-naphtho-m-toluidide)naphthalene; 2,7-bis(1'-azo-2'-hydroxy-3'-naphtho-o-chloroanilide)naphthalene; 2,7-bis(1'-azo-2'hydroxy-3'-naphtho-m-chloroanilide)naphthalene; 2,7-bis(1'-azo-2'-hydroxy-3'-naphtho-m-fluoroanilide)naphthalene; 2,7-bis(1'-azo-2'-hydroxy-3'-naphtho-o-nitroanilide)naphthalene; 2,7-bis(1'-azo-2'-hydroxy-3'-naphtho-p-nitroanilide)naphthalene; 2,7-bis(1'-azo-2'-hydroxy-3'-naphtho-o-ethylanilide)naphthalene; the derivatives thereof; and the like.

With further respect to the photoconductive imaging members of the present invention, the photogenerating azo compounds can be situated between the supporting substrate and the aryl amine hole transport layer; or alternatively, the aryl amine hole transport layer may be situated between the supporting substrate and the layer comprised of the photogenerating azo compounds illustrated herein.

In another specific illustrative embodiment, the improved photoconductive imaging member of the present invention is comprised of (1) a supporting substrate; (2) a hole blocking layer; (3) an optional adhesive interface layer; (4) a photogenerating layer comprised of an azo compound of the formula of Formula I; and (5) a hole transport layer. Therefore, the photoconductive imaging member of the present invention in one important embodiment is comprised of a conductive supporting substrate, a hole blocking metal oxide layer in contact therewith, an adhesive layer, a photogenerating layer comprised of the Formula I azo compounds overcoated on the adhesive layer, and as a top layer a hole transport layer comprised of certain aryl amines dispersed in a resinous binder.

Various known processes can be selected for the preparation of the photoconductive imaging members of the present invention, the process parameters in the order of coating of the layers being dependent on the member desired. Specifically, for example, in one method the azo photogenerating layer is deposited on a supporting substrate by vacuum sublimation, and subsequently the hole transport layer is deposited thereover by solution coating. In another process variant, the layered photoconductive device can be prepared by providing the conductive substrate containing the hole blocking layer in an optional adhesive layer and applying thereto by solvent coating processes, laminating processes, or other methods, the azo photogenerating layer and a hole transport layer.

In one specific preparation sequence there is provided a 20 percent transmissive aliminized Mylar substrate of a thickness of about 3 mils which is coated with a Bird Film Applicator at about room temperature with an adhesive, such as that available from E. I. duPont as 49,000, containing methylene chloride-trichloro ethane solvent, followed by drying at 100° C. Subsequently, there is applied to the adhesive layer an azo photogenerating layer of Formula I which application is also accomplished with a Bird Film Applicator, with annealing at 135° C., followed by coating of the amine transport layer. The aforementioned amine transport layer is applied by known solution coating techniques with a 5 mil Bird Film Applicator and annealing at 135° C., wherein the solution contains about 20 to about 80 percent by weight of the amine transport molecule, and from about 80 to about 20 percent by weight of a resinous binder substance such as a polycarbonate material.

The improved photoconductive imaging members of the present invention can be incorporated into numerous imaging processes and apparatuses inclusive of those well known as xerographic imaging processes. In these processes, the imaging members, because of their low cost, can be disposed subsequent to a certain number of imaging cycles. Also, the imaging members of the present invention are panchromatic, that is they possess sensitivity in the wavelength region of from about 400 to about 700 nanometers.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Preferred embodiments will now be illustrated with reference to specific photoconductive imaging members containing the azo compounds illustrated herein, it being noted that equivalent compositions are also embraced within the scope of the present invention.

Figure 1:
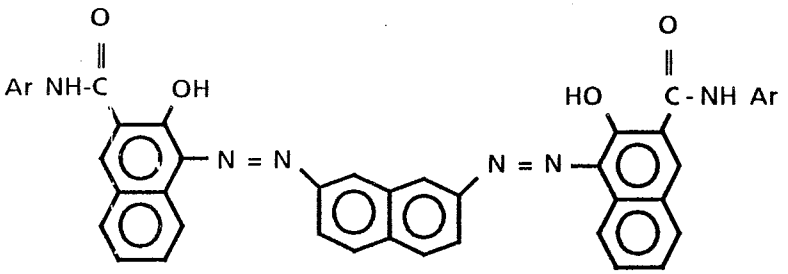
FIG. 1 represents examples of azo photogenerating pigments of the present invention.
Figure 1:
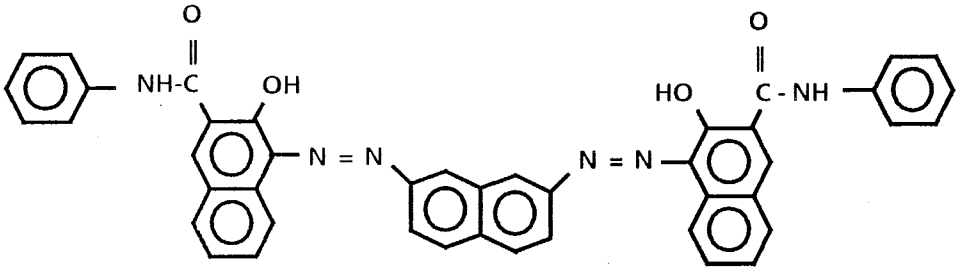
Figures 1, 2:
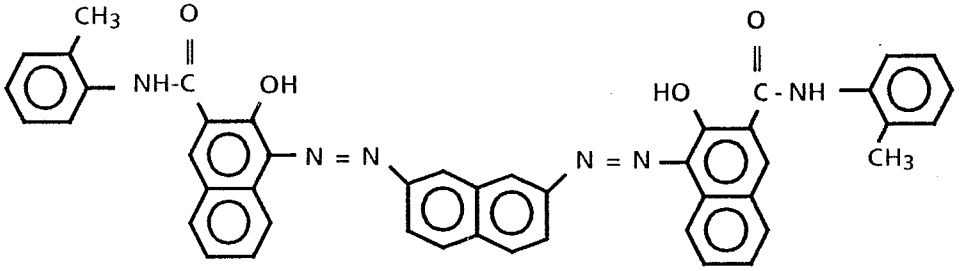
FIGS. 2, 3 and 4 are partially schematic cross-sectional views of the photoconducting members of the present invention.

Illustrated in FIG. 2 is a photoconductive imaging member of the present invention comprised of a supporting substrate 1, a photogenerating layer comprised of an azo pigment selected from the group consisting of those represented by Formula I and preferably 2,7-bis(1′-azo-2′-hydroxy-3′-naphthanilide)naphthalene 3 optionally dispersed in a resinous binder composition 4, and a charge carrier hole transport layer 5 dispersed in an inactive resinous binder composition 9.

Figures 1, 2, 3:
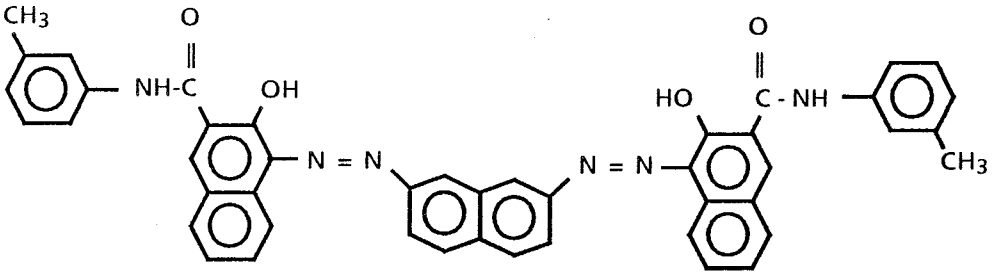

Illustrated in FIG. 3 is essentially the same member as shown in FIG. 2 with the exception that the hole transport layer is situated between the supporting substrate and the photogenerating layer. More specifically, with reference to this Figure, there is illustrated a photoconductive imaging member comprised of a supporting substrate 21, a hole transport layer 23 comprised of a hole transport composition dispersed in an inactive resinous binder composition 25, and a photogenerating layer 27 comprised of an azo of Formula I, 28 optionally dispersed in a resinous binder composition 29.

Figures 1, 2, 3, 4:
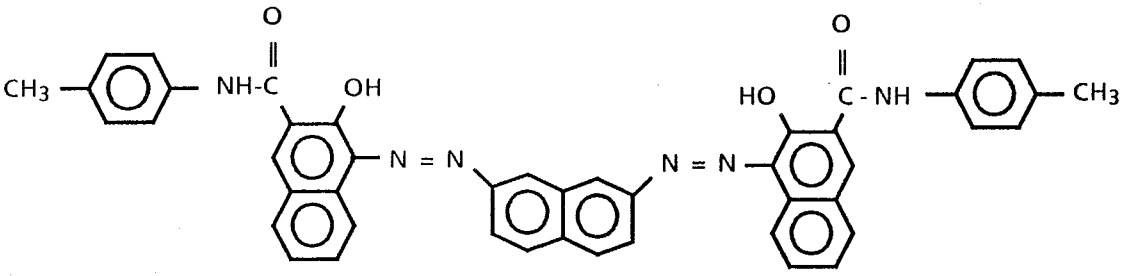
Figures 1, 2, 3, 4, 5:
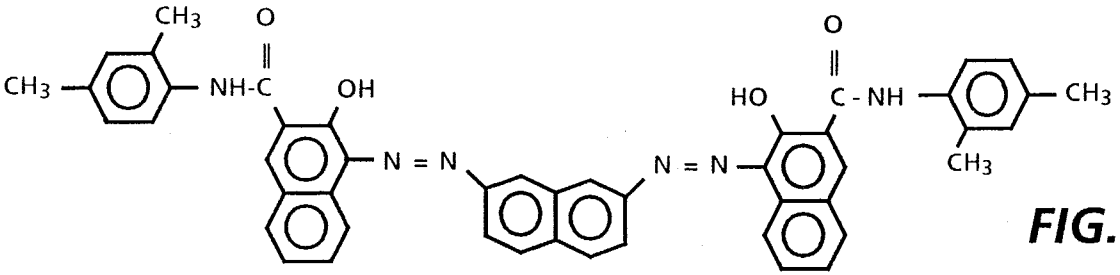
Figures 1, 2, 3, 4, 5, 6:
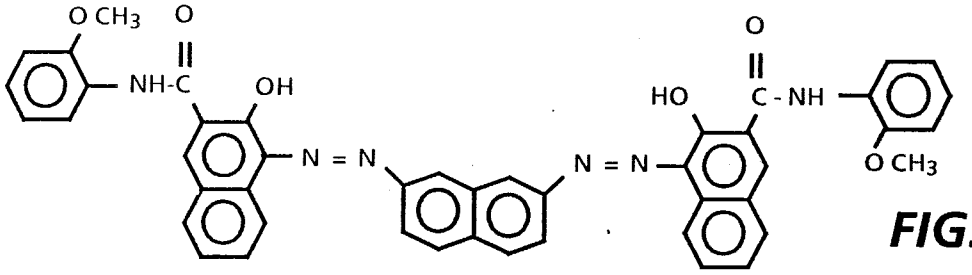
Figures 1, 2, 3, 4, 5, 6, 7:
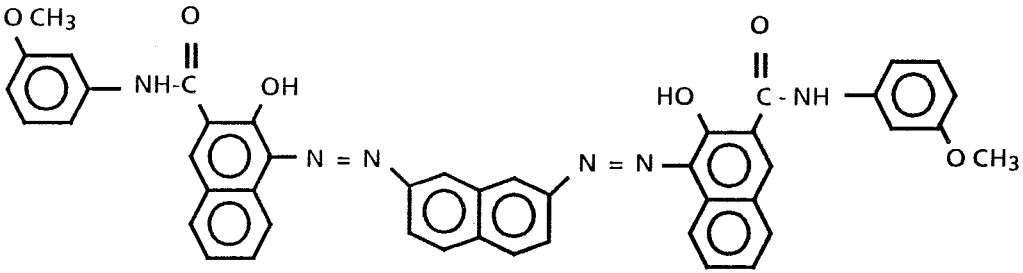
Figures 1, 2, 3, 4, 5, 6, 7, 8:
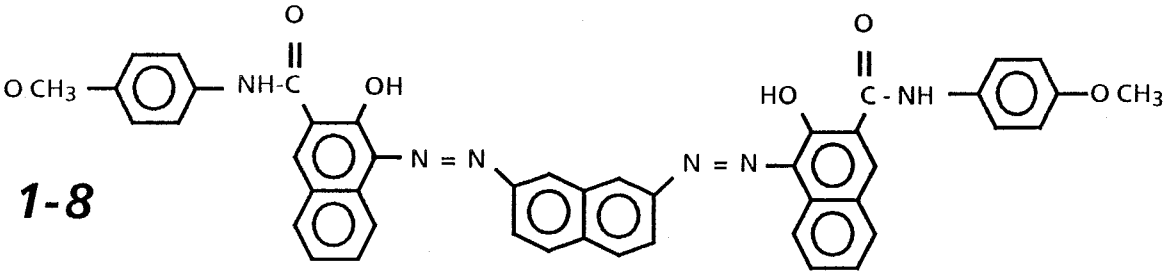
Figures 1, 2, 3, 4, 5, 6, 7, 8, 9:
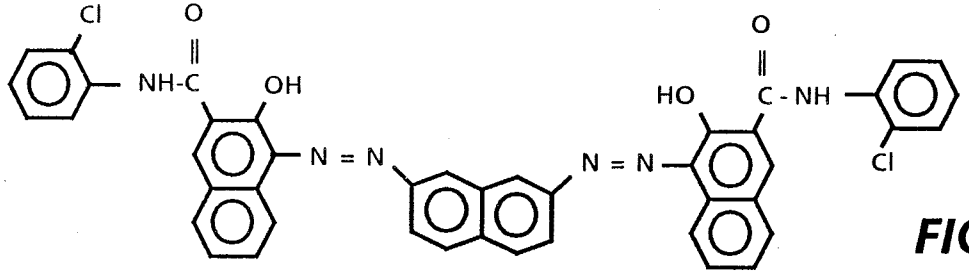
Figures 1, 2, 3, 4, 5, 6, 7, 8, 9, 10:
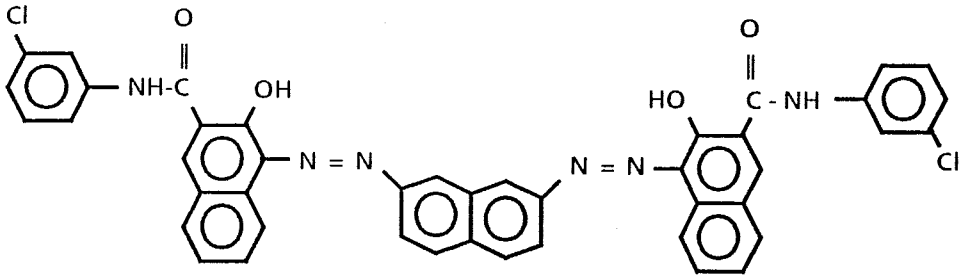
Figures 1, 2, 3, 4, 5, 6, 7, 8, 9, 10, 11:
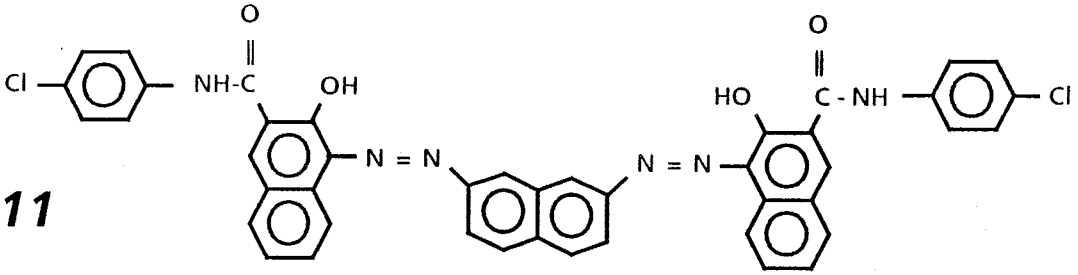
Figures 1, 2, 3, 4, 5, 6, 7, 8, 9, 10, 11, 12:
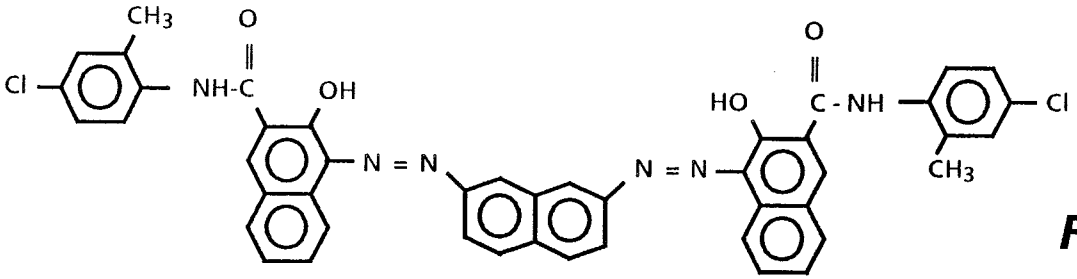
Figures 1, 2, 3, 4, 5, 6, 7, 8, 9, 10, 11, 12, 13:
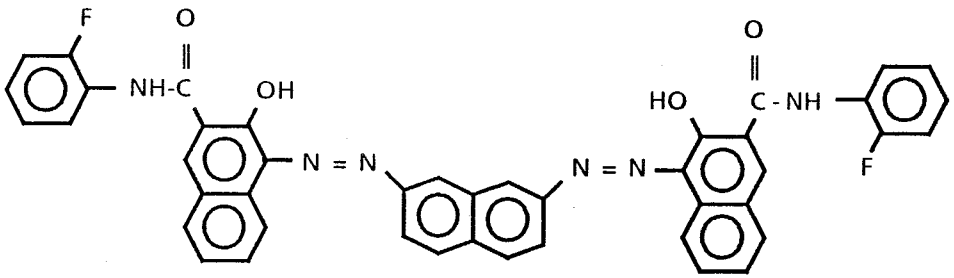
Figures 1, 2, 3, 4, 5, 6, 7, 8, 9, 10, 11, 12, 13, 14:
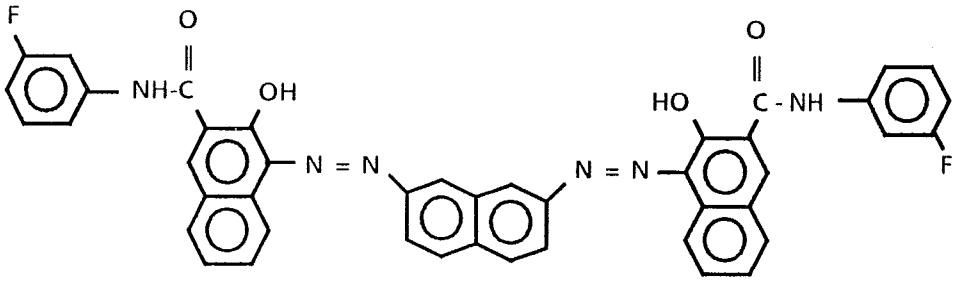
Figures 1, 2, 3, 4, 5, 6, 7, 8, 9, 10, 11, 12, 13, 14, 15:
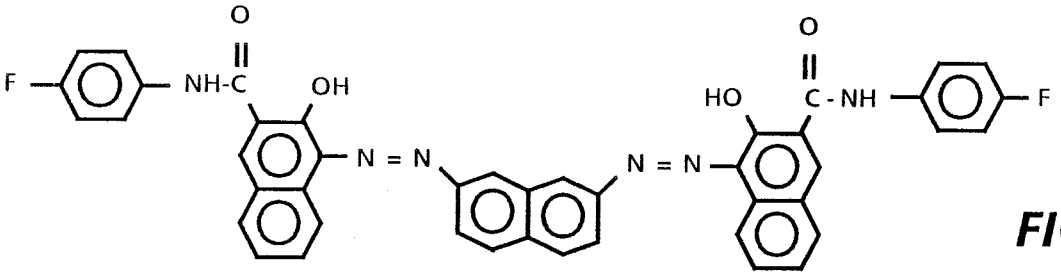
Figures 1, 2, 3, 4, 5, 6, 7, 8, 9, 10, 11, 12, 13, 14, 15, 16:
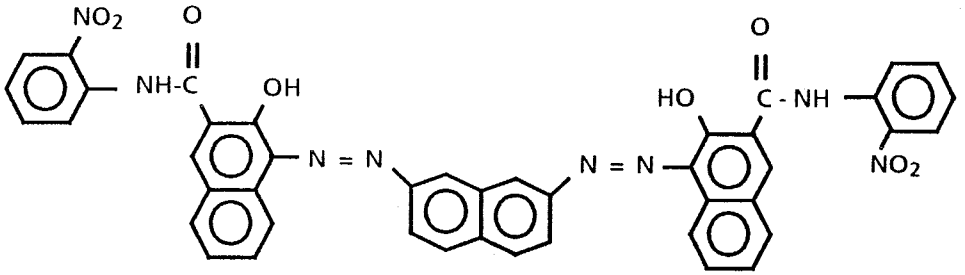
Figures 1, 2, 3, 4, 5, 6, 7, 8, 9, 10, 11, 12, 13, 14, 15, 16, 17:
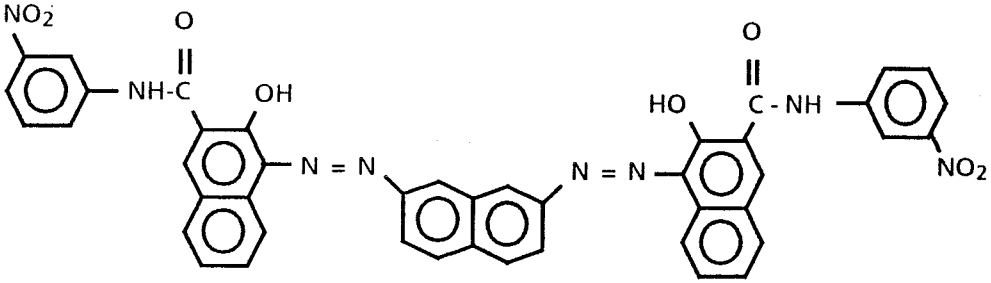
Figures 1, 2, 3, 4, 5, 6, 7, 8, 9, 10, 11, 12, 13, 14, 15, 16, 17, 18:
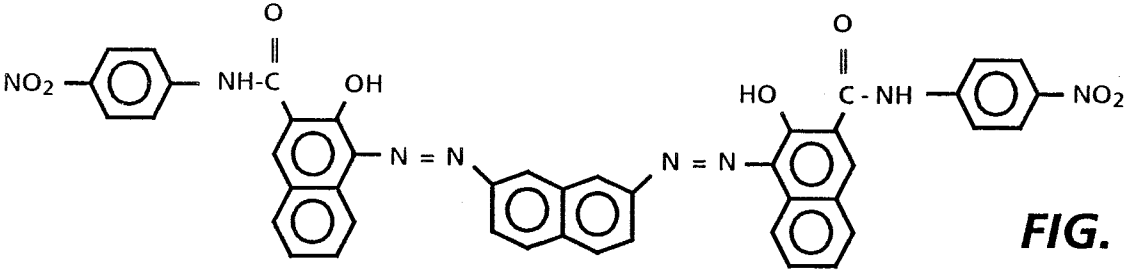
Figures 1, 2, 3, 4, 5, 6, 7, 8, 9, 10, 11, 12, 13, 14, 15, 16, 17, 18, 19:
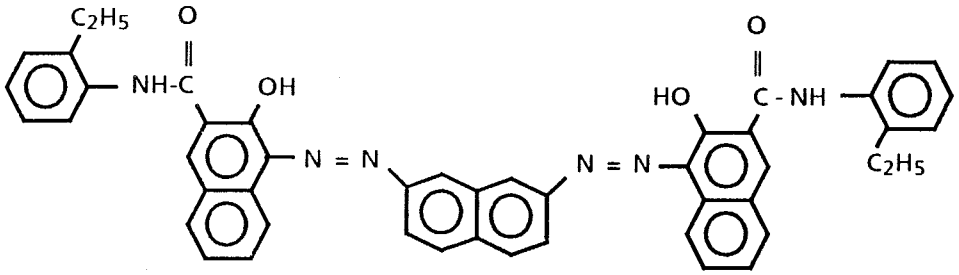
Figures 1, 2, 3, 4, 5, 6, 7, 8, 9, 10, 11, 12, 13, 14, 15, 16, 17, 18, 19, 20:
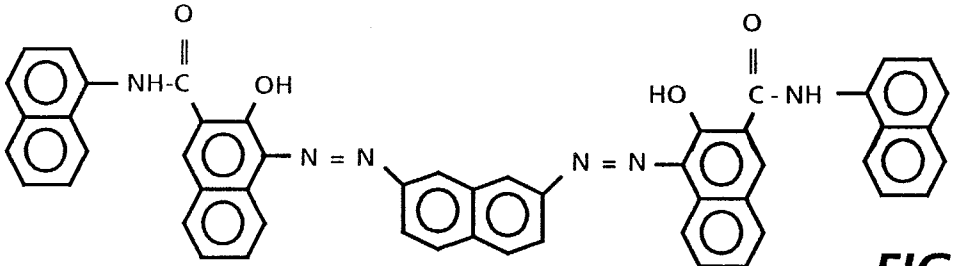
Figures 1, 2, 3, 4, 5, 6, 7, 8, 9, 10, 11, 12, 13, 14, 15, 16, 17, 18, 19, 20, 21:
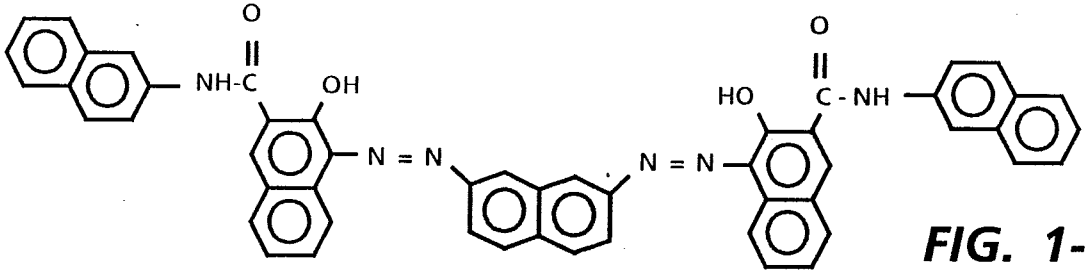
Figures 1, 2, 3, 4, 5, 6, 7, 8, 9, 10, 11, 12, 13, 14, 15, 16, 17, 18, 19, 20, 21, 22:
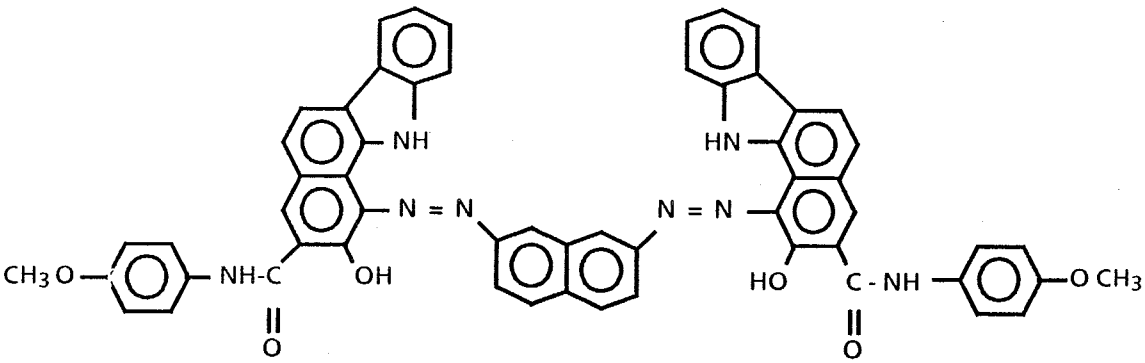
Figure 2:
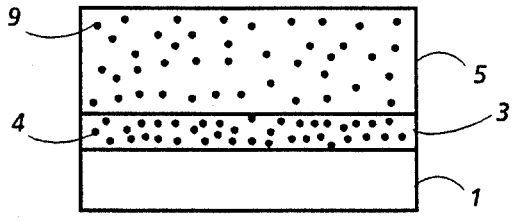
Figure 3:
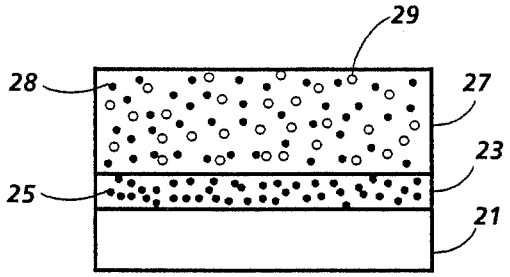
Figure 4:
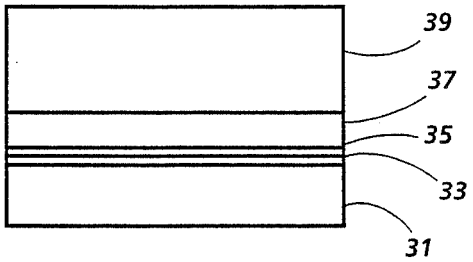

Illustrated in FIG. 4 is a photoconductive imaging member of the present invention comprised of a supporting substrate 31, a hole blocking metal oxide layer 33, an optional adhesive layer 35, an azo photogenerating layer 37 comprised of an azo compound of Formula I, and a charge carrier or hole transport layer 39. The photogenerating layer is generally comprised of the azo compound optionally dispersed in a resinous binder composition, and similarly the charge transport layer such as aryl diamines are dispersed in inactive resinous binder materials.

Other photoconductive imaging members not specifically illustrated are encompassed within the scope of the present invention including those wherein the azo compound is substantially equivalent to those illustrated herein.

With further reference to FIGS. 2 to 4, the substrates may comprise a layer of insulating material such as an inorganic or organic polymeric material, including Mylar a commercially available polymer; a layer of an organic or inorganic material having a semiconductive surface layer such as indium tin oxide or aluminum arranged thereon, or a conductive material such as, for example, aluminum, chromium, nickel, brass or the like. The substrate may be flexible or rigid and many have a number of many different configurations, such as for example, a plate, a cylindrical drum, a scroll, an endless flexible belt and the like. Preferably, the substrate is in the form of an endless flexible belt. In some situations, it may be desirable to coat on the back of the substrate, particularly when the substrate is an organic polymeric material, an anti-curl layer, such as for example polycarbonate materials commercially available as Makrolon.

The thickness of the substrate layer depends on many factors, including economical considerations, thus this layer may be of substantial thickness, for example over 100 mils, or of minimum thickness providing there are no adverse effects on the system. In one preferred embodiment, the thickness of this layer is from about 3 mils to about 10 mils.

Also, the hole blocking metal oxide layers can be comprised of various suitable known materials including aluminum oxide and the like. The primary purpose of this layer is to provide hole blocking, that is, to prevent hole injection from the substrate during and after charging. Typically, this layer is of a thickness of less than 50 Angstroms.

The adhesive layers are typically comprised of a polymeric material including polyesters, polyvinyl butyral, polyvinyl pyrrolidone and the like. Typically, this layer is of a thickness of less than about 0.6 microns.

Examples of the photogenerating layers include the azo compounds as illustrated hereinbefore. Generally, this layer is of a thickness of from about 0.05 microns to about 10 microns, or more; and preferably is of a thickness of from about 0.1 microns to about 3 microns; however, the thickness of this layer is primarily dependent on the photogenerating weight loading which may vary from about 5 to 100 percent. Generally, it is desirable to provide this layer in a thickness which is sufficient to absorb about 90 percent or more of the incident radiation which is directed upon it, in the imagewise or printing exposure step. The maximum thickness of this layer is dependent primarily upon factors such as mechanical considerations, for example, whether a flexible photoconductive imaging member is desired, the thicknesses of the other layers, and the specific azo compound selected.

Various suitable charge transport layers can be selected for the photoconductive imaging member of the present invention, which layer has a thickness of from about 5 microns to about 50 microns; and preferably is of a thickness of from about 10 microns to about 40 microns. In a preferred embodiment, this transport layer comprises aryl amine molecules of the following formula

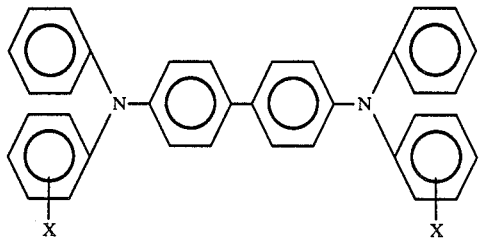

dispersed in a highly insulating and transparent organic resinous binder wherein X is selected from the group consisting of (ortho) $CH_3$, (meta) $CH_3$, (para) $CH_3$, (ortho) Cl, (meta) Cl, (para) Cl. The highly insulating resin, which has a resistivity of at least $10^{12}$ ohm-cm to prevent undue dark decay, is a material which is not necessarily capable of supporting the injection of holes. However, the insulating resin becomes electrically active when it contains from about 10 to 75 weight percent of the substituted N,N,N',N'-tetraphenyl[1,1-biphenyl]-4,4'-diamines corresponding to the foregoing formula.

Compounds corresponding to the above formula include, for example, N,N'-diphenyl-N,N'-bis(alkylphenyl)-[1,1-biphenyl]-4,4'-diamine wherein the alkyl is selected from the group consisting of methyl such as 2-methyl, 3-methyl and 4-methyl, ethyl, propyl, butyl, hexyl and the like. With halo substitution, the amine is N,N'-diphenyl-N,N'bis(halo phenyl)[1,1'-biphenyl]-4,4'-diamine wherein halo is 2-chloro, 3-chloro or 4-chloro.

Other electrically active small molecules which can be dispersed in the electrically inactive resin to form a layer which will transport holes include, bis(4-diethylamino-2-methylphenyl)phenyl methane; 4',4''-bis(-diethylamino)-2',2''-dimethyltriphenyl methane; bis-4-(diethylaminophenyl)phenyl methane; and 4,4'-bis(diethylamino)-2,2'-dimethyltriphenyl methane.

Providing the objectives of the present invention are achieved, other charge carrier transport molecules can be selected for the photoconductive device of the present invention including those wherein X is other alkyl, or halogen substituents.

Examples of the highly insulating and transparent resinous material or inactive binder resinous material for the transport layers include materials such as those described in U.S. Pat. No. 3,121,006, the disclosure of which is totally incorporated herein by reference. Specific examples of organic resinous materials include polycarbonates, arcylate polymers, vinyl polymers, cellulose polymers, polyesters, polysiloxanes, polyamides, polyurethanes, and epoxies as well as block, random or alternating copolymers thereof. Preferred electrically inactive binder materials are polycarbonate resins having a molecular weight (Mw) of from about 20,000 to about 100,000 with a molecular weight in the range of from about 50,000 to about 100,000 being particularly preferred. Generally, the resinous binder contains from about 10 to about 75 percent by weight of the active material corresponding to the foregoing formula, and preferably from about 35 percent to about 50 percent of this material.

Similar binder materials can be selected for the azo photogenerating layer, inclusive of those as illustrated in U.S. Pat. No. 3,121,006, the disclosure of which is totally incorporated herein by reference. A preferred binder material for the azo photogenerating layer is poly(vinyl acetal).

Also included within the scope of the present invention are methods of imaging with the photoresponsive devices illustrated herein. These methods of imaging generally involve the formation of an electrostatic latent image on the imaging member, followed by developing the image with known developer compositions, subsequently transfering the image to a suitable substrate and permanently affixing the image thereto.

The azo compounds of general Formula I were generally prepared by first tetrazotizing 2,7-diaminonaphthalene with an excess amount of a metallic nitride, such as sodium nitrite at about −10° to 20° C. in an aqueous, including hydrochloric acid, solution. The tetrazonium salts formed were usually isolated as fluoroborate or hexafluorophosphate salts, which was accomplished by adding $HBF_4$ or $HPF_6$ to the tetrazotization salt solution. The salts obtained were then dissolved in dimethylformamide (DMF) at 0° to 30° C., and were allowed to react with about 2 equivalents of an azo coupler, such as 2-hydroxy naphthanilide, at the same temperature. Thereafter, the desired azo pigments were precipitated out of the solution when about 2 equivalents of a base, such as sodium acetate, was introduced therein. Subsequently, azo pigments were isolated by filtration and purified by repetitive solvent washings. The azo products resulting were characterized by elemental analysis, melting point, and IR spectroscopy.

The invention will now be described in detail with reference to specific preferred embodiments thereof, it being understood that these examples are intended to be illustrative only. The invention is not intended to be limited to the materials, conditions, or process parameters recited herein, it being noted that all parts and percentages are by weight unless otherwise indicated.

EXAMPLE I

There was prepared 2,7-bis(1'-azo-2'-hydroxy-3'-naphthanilide)naphthalene by the tetrazotization reaction of 0.8 grams, 5 millimoles, of 2,7-diaminonaphthalene at −5° C. to 0° C. in 20 milliliters of 18 percent hydrochloric acid solution, which tetrazotization was affected with a 2.5 milliliters aqueous solution containing 1 gram of sodium nitrite. Subsequent to the dissolution of the diamine compound, the unreacted 1,5-diaminonaphthalene was removed by filtration. Thereafter, 20 milliliters $HPF_6$ solution (60% by weight) was added to the filtrate. Subsequently, the light orange precipitate resulting was collected by filtration and after washing with cold water, alcohol and ether, the tetrazonium salt obtained was air-dried. Thereafter, this salt, ~2.3 grams, was dissolved in 40 milliliters of icecold N,N-dimethylformamide in an ice-bath. Subsequently, 2.89 grams of an azo coupler, 2-hydroxy-3-naphthanilide; in 250 milliliters N,N-dimethylformamide was added slowly to the tetrazonium salt solution. This solution changed from a red color to a darker red. There was then added to the dark red solution 75 milliliters of an aqueous solution containing 5 grams of sodium acetate. Subsequently, there was immediately formed the disazo compound product which was stirred at room temperature for three or more hours. After filtration, the product was washed with N,N-dimethylformamide (3×250 milliliters), water (2×250 milliliters), acetone (1×250 milliliters) and diethyl ether (1×250 milliliters), to yield 2.4 grams, 67 percent of the desired product 2.7-bis(1'-azo-2'-hydroxy-3'-naphthanilide)naphthalene.

EXAMPLE II

There was prepared a photoconductive imaging member containing as the photogenerating azo compound the 2,7-bis(1'-azo-2'-hydroxy-3'-naphthanilide)-naphthalene prepared in accordance with the process of Example I. The photogenerating pigment dispersion was prepared by first dissolving 52.8 milligrams of poly(vinyl formal) in 10 milliliters of tetrahydrofuran in a 1 oz. brown bottle. The above azo compound, 211.2 milligrams, and ~90 grams of steel shots (⅛ inch diameter, #302 grade) were added to the polymer solution. The brown bottle was then placed in a Red Devil Paint Conditioner (Model 5100X) and was shaken for 30 minutes. The resulting dispersion was coated onto a 7.5 inch×10 inch aluminum substrate using a Gardner Mechanical Drive Film Application with a 6 inch wide Bird Film Applicator (0.5 mil wet gap) inside a humidity-controlled glove box. The relative humidity of the glove box was controlled by dry air and was <25 percent for all the coatings accomplished. The resulting carrier generation layer (CGL) was air-dried for ~30 minutes and vacuum-dried at 100° C. for ~1 hour before further coating. The thickness of the CGL was found to be ~0.5 μm as estimated from TEM micrographs.

A transport layer composed of about 60 percent by weight of Makrolon® polycarbonate resin available from Larbensabricken Bayer AG, mixed with 40 percent by weight of N,N'-bis(3-methylphenyl)-1,1'-biphenyl-4,4'-diamine was then prepared. This solution which was comprised of 4.2 grams of Makrolon®, 2,8 grams of the diamine, and 31 milliliters of methylene chloride was placed in an amber bottle and dissolved. The charge transport layer was obtained by coating the diamine solution onto the above azo photogenerating layer using a 5 mil wet gap Bird Film Applicator. The thickness of the transport layer was ~27 μm. The resulting photoconductive imaging member was air-dried for 1 hour and vacuum-dried for 6 hours or more. The xerographic properties of this device were then evaluated on a flat plate scanner text fixture. The results are summarized as follows:

| | |
|---|---|
| $V_{ddp}$ (Volts) (dark development potential) | −960 |
| Dark Decay (volt/sec) | −75 |
| $E_{0.5ddp}$ at 600 nanometers (erg/cm$^2$) (energy to discharge of the potential) | 5.0 |

EXAMPLE III

There were prepared other photoconductive imaging members by repeating the procedure of Example II with the exception that other azo photogenerating pigments of Formula I, reference FIGS. 1-1 to 1-22, were selected. The xerographic properties of these imaging members were then evaluated on a flat plate scanner text fixture. The results are provided in the Tables, FIGS. 1A and 1B.

The disclosure of related copending application Ser. No. 851,051 entitled Organic Azo Photoconductor Imaging Members is totally incorporated herein by reference.

With further respect to the azo compounds of Formula I, the phenyl ring attached to the hydroxy phenyl substituent can be replaced by other suitable groups including carbazole, naphthyl and anthryl.

In the flat plate tests the photoconductor device was charged by a corotron maintained at a voltage of −5.7 kilovolts. The dark development potential and dark decay values in all instances were determined by an electrometer probe; and the photosensitivity was the energy required to discharge ½ of the development potential.

Also, other azo compounds were prepared by repeating the procedure of Example I with the exception that there were selected as azo couplers 2-hydroxy-3-naphtho-p-toluide; 2-hydroxy-3-naphtho-m-chloroanilide; 2-hydroxy-3-naphtho-p-fluoroanilide; 2-hydroxy-3-naphtho-o-nitroanilide; 2-hydroxy-3-naphtho-o-nitroanilide; 2-hydroxy-3-naphtho-m-anisidide; 2-hydroxy-N-2-naphthyl-2-naphthamide; and other similar azo couplers.

Although the invention has been described with reference to specific preferred embodiments, it is not intended to be limited thereto, rather those skilled in the art will recognize that variations and modifications may be made therein which are within the spirit of the present invention and within the intent of the following claims.

What is claimed is:

1. An imaging member comprised of a supporting substrate, a photogenerating pigment containing an azo compound of the following formula

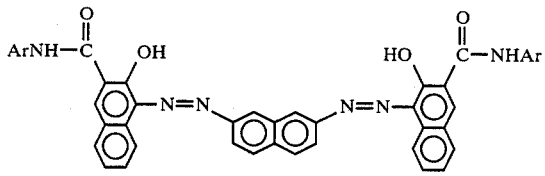

wherein Ar is an aromatic or substituted aromatic substituent; and a hole transport layer.

2. An imaging member in accordance with claim 1 wherein the aryl substituent contains from about 6 to about 24 carbon atoms.

3. An imaging member in accordance with claim 1 wherein the aryl substituent is phenyl.

4. An imaging member in accordance with claim 1 wherein the aryl substituent is substituted with alkyl, alkoxy, halogen, or nitro.

5. An imaging member in accordance with claim 4 wherein the alkyl substituent contains from about 1 to about 24 carbon atoms.

6. An imaging member in accordance with claim 4 wherein the alkyl substituent is methyl.

7. An imaging member in accordance with claim 4 wherein the alkoxy substituent contains from about 1 to about 24 carbon atoms.

8. An imaging member in accordance with claim 4 wherein the alkoxy substituent is methoxy.

9. An imaging member in accordance with claim 1 wherein the halogen is chlorine, bromine, fluorine or iodine.

10. An imaging member in accordance with claim 1 wherein the azo pigment is 2,7-bis(1'-azo-2'-hydroxy-3'-naphthanilide)naphthalene.

11. An imaging member in accordance with claim 1 wherein the azo compound is 2,7-bis(1'-azo-2'-hydroxy-3'naphtho-p-toluidide)naphthalene.

12. An imaging member in accordance with claim 1 wherein the azo compound is 2,7-bis(1'-azo-2'-hydroxy-3'-naphtho-m-toluidide)naphthalene.

13. An imaging member in accordance with claim 1 wherein the azo compound is 2,7-bis(1'-azo-2'-hydroxy-3'-naphtho-o-chloroanilide)naphthalene.

14. An imaging member in accordance with claim 1 wherein the azo compound is 2,7-bis(1'azo-2'-hydroxy-3'-naphtho-m-chloroanilide)naphthalene.

15. An imaging member is accordance with claim 1 wherein the azo compound is 2,7-bis(1'-azo-2'-hydroxy-3'-naphtho-m-fluoroanilide)naphthalene.

16. An imaging member in accordance with claim 1 wherein the azo compound is 2,7-bis(1'-azo-2'-hydroxy-3'-naphtho-o-nitroanilide)naphthalene.

17. An imaging member in accordance with claim 1 wherein the azo compound is 2,7-bis(1'-azo-2'-hydroxy-3'-naphtho-p-nitroanilide)naphthalene.

18. An imaging member in accordance with claim 1 wherein the azo compound is 2,7-bis(1'-azo-2'-hydroxy-3'-naphtho-o-ethylanilide)naphthalene.

19. An imaging member in accordance with claim 1 wherein the hole transport layer comprises an aryl amine of the formula

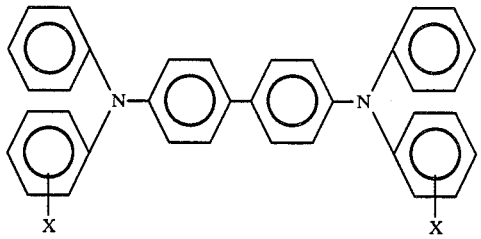

wherein X is selected from the group consisting of alkyl and halogen.

20. An imaging member in accordance with claim 19 wherein X is ortho ($CH_3$), meta ($CH_3$), para ($CH_3$), ortho (Cl), meta (Cl), or para (Cl).

21. An imaging member in accordance with claim 1 wherein the supporting substrate is comprised of aluminum.

22. An imaging member in accordance with claim 1 wherein the supporting substrate is comprised of a polymeric organic composition.

23. An imaging member comprised of (1) a supporting substrate; (2) a metal oxide hole blocking layer; (3) an azo generating layer comprised of the azo compounds of claim 1; and (4) a hole transport layer.

24. An imaging member in accordance with claim 23 wherein the aryl substituent contains from about 6 to about 24 carbon atoms.

25. An imaging member in accordance with claim 23 wherein the aryl substituent is phenyl.

26. An imaginhg member in accordance with claim 23 wherein the aryl substituent is substituted with alkyl, alkoxy, halogen, or nitro.

27. An imaging member in accordance with claim 26 wherein the alkyl substituent contains from about 1 to about 24 carbon atoms.

28. An imaging member in accordance with claim 26 wherein the alkyl substituent is methyl.

29. An imaging member in accordance with claim 26 wherein the alkoxy substituent contains from about 1 to about 24 carbon atoms.

30. An imaging member in accordance with claim 26 wherein the alkoxy substituent is methoxy.

31. An imaging member in accordance with the claim 23 wherein the halogen is chlorine, bromine, fluorine or iodine.

32. An imaging member in accordance with claim 23 wherein the azo pigment is 2,7-bis(1'-azo-2'-hydroxy-3'-naphthanilide)naphthalene.

33. A method of imaging which comprises generating an electrostatic latent image on the photoconductive imaging member of claim 1; subsequently developing this image; and thereafter transfering the developed image to a suitable substrate.

34. A method of imaging in accordance with claim 33 wherein the aryl substituent contains from about 6 to about 24 carbon atoms.

35. A method of imaging in accordance with claim 33 wherein the aryl substituent is phenyl.

36. A method of imaging in accordance with claim 33 wherein the aryl substituent is substituted with alkyl, alkoxy, halogen, or nitro.

37. A method of imaging in accordance with claim 36 wherein the alkyl substituent contains from about 1 to about 24 carbon atoms.

38. A method of imaging in accordance with claim 36 wherein the alkyl substituent is methyl.

39. A method of imaging in accordance with claim 36 wherein the alkoxy substituent contains from about 1 to about 24 carbon atoms.

40. A method of imaging in accordance with claim 36 wherein the alkoxy substituent is methoxy.

41. A method of imaging in accordance with claim 33 wherein the halogen is chlorine, bromine, fluorine or iodine.

42. A method of imaging in accordance with claim 33 wherein the azo pigment is 2,7-bis(1'-azo-2'-hydroxy-3'-naphthanilide)naphthalene.

43. An imaging member in accordance with claim 23 wherein the hole blocking layer is aluminum oxide.

44. An imaging member in accordance with claim 23 wherein the member further includes an adhesive layer.

* * * * *